US006338876B1

(12) United States Patent
Ishii et al.

(10) Patent No.: US 6,338,876 B1
(45) Date of Patent: Jan. 15, 2002

(54) PROCESS FOR HYDROPHILIC TREATMENT OF ALUMINUM MATERIALS AND PRIMERS THEREFOR AND HYDROPHILIC COATINGS

(75) Inventors: Toru Ishii; Kazuhiko Yamazaki, both of Shizuoka (JP)

(73) Assignee: Nippon Light Metal Company, LTD, Tokyo (JP)

( * ) Notice: Subject to any disclaimer, the term of this patent is extended or adjusted under 35 U.S.C. 154(b) by 0 days.

(21) Appl. No.: 09/512,221

(22) Filed: Feb. 24, 2000

(30) Foreign Application Priority Data

Feb. 26, 1999 (JP) ..... 11-051748

(51) Int. Cl.[7] ..... B05D 1/38; B05D 3/02
(52) U.S. Cl. ..... 427/409; 427/419.1; 427/419.2
(58) Field of Search ..... 427/409, 419.1, 427/419.2

(56) References Cited

FOREIGN PATENT DOCUMENTS

EP 839931 * 5/1998
JP 03-081139 * 4/1991
JP 06-248232 * 9/1994

OTHER PUBLICATIONS

Abstract of Japanese Patent Publ. No. 62010280; dated Jan. 19, 1987.

* cited by examiner

*Primary Examiner*—Erma Cameron
(74) *Attorney, Agent, or Firm*—Arent Fox Kintner Plotkin & Kahn, PLLC

(57) ABSTRACT

This invention relates to a process for hydrophilic treatment of an aluminum material comprising a step for priming in which a primer containing the nitrate or related compound of a metal selected from aluminum, zirconium, cerium, chromium, and iron is applied to the surface of an aluminum material so that the amount of adhering metal becomes 1.0 mM/m$^2$ or more and then the primer is baked at the specified temperature and a step for coating in which a hydrophilic coating is applied to the primer film formed in said step for priming and then baked at the specified temperature. This invention also relates to primers and hydrophilic coatings useful for the aforementioned treatments. It is possible to form a hydrophilic film, with pronounced hyrdophilicity particularly after press forming, on the surface of an aluminum material.

7 Claims, 5 Drawing Sheets

PROCESS FOR HYDROPHILIC TREATMENT OF ALUMINUM MATERIALS AND PRIMERS THEREFOR AND HYDROPHILIC COATINGS

FIELD OF THE INVENTION AND RELATED ART STATEMENT

This invention relates to a process for hydrophilic treatment of articles made from aluminum or aluminum alloys (hereinafter referred to as aluminum materials) to bestow hydrophilicity on the surface, to primers useful for said hydrophilic treatment and to hydrophilic coatings.

Aluminum materials are generally characterized by lightweight, good processability, and excellent thermal conductivity and are widely used in air conditioners as fins in the heat-exchanging units, in construction materials such as sashes, and in many other applications. A variety of coatings are applied to the surface of aluminum materials depending upon where and for what purposes they are used.

In particular, bestowment of hydrophilicity on the surface of fins in heat-exchanging units or of construction materials is extremely important as it serves the purpose of preventing moisture condensation and reflector fogging or keeping construction materials from staining (stains adhering to the surface are washed away by rainwater if the surface is highly hydrophilic); furthermore, in the case of fins in heat-exchanging units, raising of thermal efficiency contributes to saving of energy.

However, when a coating designed for bestowing hydrophilicity is applied directly to the surface of an aluminum material, the coating film itself preferentially adsorbs moisture in the air; as a result, the moisture content on the surface increases and the aluminum material tends to corrode or a hydrated oxide layer formed as a result of corrosion tends to grow thicker and besides such oxide is brittle. Hence, the hydrophilic film formed on the surface of the aluminum material peels off relatively easily.

Several procedures for anticorrosive priming have hitherto been proposed to solve the aforementioned problems: for example, (1) to form a film chemically on the surface of aluminum by a chromate-, titanium- or zirconium-based primer; (2) to apply a primer called coat-type chromate to the surface of aluminum and dry by heating to insolubilize the primer film; and (3) to apply a resin-based primer. Incidentally, the films to be obtained by the aforementioned procedures are fundamentally water-repellent and, in case such films are to be formed on the fins in heat exchangers, they must indispensably be treated to render them hydrophilic, for example, by the following procedures: ① to apply water glass [for example, as described in Japan Kokai Tokkyo Koho Sho 58-126989 (1983)]; ② by to apply coatings composed of organic resins and silica or to apply these coatings together with surfactants; ③ at to apply coatings composed of organic-inorganic (silica) composite coatings and surfactants [for example, as disclosed in Japan Kokai Tokkyo Koho Sho 59-170170 (1984)]; and ④ to apply coatings composed of organic hydrophilic resins [for example, as disclosed in Japan Kokai Tokkyo Koho Sho 64-38481 (1989), Japan Kokai Tokkyo Koho Hei 1-299877 (1989), and Japan Kokai Tokkyo Koho Hei 5-302042 (1993)].

However, these known procedures for anticorrosive priming and hydrophilic treatment had latent problems and some of them have already become reality while others are beginning to attract attention as to their existence.

As for the anticorrosive priming, chromium-based chemical primers and coat-type chromate are still widely used at present as they readily produce films of good corrosion resistance at low cost.

However, these chromium-based primers are suspected of carcinogenicity and, besides, highly toxic Cr(VI) is present not only in the course of treatment but also in the films formed; in consequence, they are beginning to be placed under rigid regulation from the standpoint of both environmental protection and recycling. On the other hand, titanium- or zirconium-based chemical primers are free of such hazards inherent in chromium-based primers, but the growth rate of their films is so low that the productivity needs to be sacrificed to develop sufficient corrosion resistance. In the case of resin-based primers, an increase in film thickness can secure required corrosion resistance, but this lowers the thermal conductivity which is an extremely important characteristic of materials to be used in fabricating fins.

As for the hydrophilic treatment, the films formed from water glass have a merit of low cost, but they have been criticized for abrading the metal mold or emitting a "strongly musty odor" at the startup of an air conditioner in cooling mode. Moreover, rapid loss of their hydrophilicity in a short time by the action of environmental pollutants such as VOC (volatile organic compounds) emitted from newly developed construction materials and from flooring has recently become a tangible problem and there is an incipient move to restrict their usage greatly. The films formed from organic-inorganic composite primers suffer less from the problem of odor or influenced less in hydrophilicity by environmental pollutants than the films of water glass, but they cannot remain unaffected by the problem of abrasion of the metal mold on account of the use of silica in them. By comparison, the organic hydrophilic films have a merit of being affected insignificantly by such problems as abrasion of the metal mold, odor, and degradation of hydrophilicity by environmental pollutants, but it is pointed out that the organic hydrophilic films have shortcomings of tending to lose hydrophilicity under the influence of heat or press oil more easily than the inorganic films.

Regarding the aforementioned effect of heat, the organic films are heated in two ways; ① baking and drying of coatings and ② drying by heating of volatile press oil applied to the hydrophilic film in order to raise the lubricity during press molding. Heat is applied normally at 200 to 300° C. for several seconds to ten and several seconds in the case ① and at 100 to 200° C. for several minutes to several tens of minutes in the case ①.

Why the hydrophilicity deteriorates by heat is not known clearly, but the plausible explanation is that the hydrophilic groups react with other functional groups during heating resulting in the decrease in the number of hydrophilic groups in① and the hydrophilic groups present on the surface deteriorate by heat or the hydrophilic groups appearing on the surface of the film become unstable energy-wise on account of the hot air itself being hydrophobic and migrate into the more stable inside of the film to cause a decrease in the number of hydrophilic groups on the surface with a concomitant decrease in hydrophilicity in the case ②.

A remedial measure taken for the case ① has been to avoid the simultaneous use of components reactive with the hydrophilic groups or to avoid conducting baking and drying at temperatures favorable for accelerating the reaction of the hydrophilic groups, but under existing circumstances the range of control is too narrow to develop sufficient countermeasures on a commercial scale. As for the case ②, no countermeasure whatsoever is available at the present time.

The effects of press oil are as follows. Press oils currently in practical use are said to be composed mainly of paraffinic hydrocarbons and additives for improving the lubricity. Decrease in hydrophilicity by press oil is ascribed to a part of the components of press oil remaining on the surface of the film. In the case of the films of water glass, the films are alkaline and the residual organic substances are saponified to become soluble in water and the decrease in hydrophilicity posed virtually no problem. However, it is a big problem in the organic films and a variety of proposals have been made to deal with the problem.

For example, Japan Kokai Tokkyo Koho Sho 62-234926 (1987) proposes to apply water-soluble organic polymers of low molecular weight on the hydrophilic films to avoid direct contact of press oil with the hydrophilic films. Japan Kokai Tokkyo Koho Sho 64-61239 (1989) proposes to add a surfactant to the hydrophilic resin component and let the surfactant emulsify and remove the residual press oil.

However, the aforementioned procedures for getting rid of the adverse effects of press oil have encountered, for example, the following problems: the water-soluble polymers adhere to the surface depending upon the drying conditions for press oil and hinder the hydrophilic function of the hydrophilic films or the water-soluble polymers dissolve out together with the residual press oil during the pressure leakage test conducted by immersing the assembled heat exchanger in water and render the test water turbid to lower the accuracy of the testing. Furthermore, in case a surfactant is used, it dissolves gradually into the condensate while the air conditioner is run in cooling mode and damages an injection-molded plastic receiver for the condensate.

OBJECT AND SUMMARY OF THE INVENTION

The present inventors have conducted extensive studies on how to conduct hydrophilic treatment on the surface of an aluminum material, particularly after press forming, to provide excellent hydrophilicity with the use of a primer which is not based on chromium but equal to chromium-based primers in corrosion resistance and a hydrophilic coating which is free from the problems of abrasion of the metal mold and odor, suffers an insignificant loss in its hydrophilicity after baking, after drying of press oil by heating, or after start of usage as part of the end product, and does not constitute a source of troubles during manufacture or usage as product of air conditioners, found that a hydrophilic film with excellent corrosion resistance and hydrophilicity, particularly, with lasting hydrophilicity after press forming, can be formed by applying a coat-type primer containing the nitrate or related compound of a specified metal to the surface of an aluminum material to form a primer film containing 1.0 $mM/m^2$ or more of adhering metal and then applying a hydrophilic coating mainly composed of polyvinyl alcohol and polyethylene glycol to form a hydrophilic film on the primer film, and completed this invention.

Accordingly, an object of this invention is to provide a process for hydrophilic treatment of an aluminum material for the formation of a hydrophilic film on the surface of the aluminum material with excellent hydrophilicity, particularly after press forming, and hydrophilicity of lasting nature, namely excellent hydrophilicity after coating with press oil and drying of the oil by heating and also excellent hydrophilicity after immersion in water for 100 hours.

Another object of this invention is to provide primers and hydrophilic coatings useful for the formation of hydrophilic films on the surface of an aluminum material with excellent hydrophilicity, particularly after press forming, and hydrophilicity of lasting nature, namely, excellent hydrophilicity after coating with press oil and drying of the oil by heating and also excellent hydrophilicity after immersion in water for 100 hours.

This invention thus relates to a process for hydrophilic treatment of an aluminum material which comprises a step for priming wherein a primer containing the nitrate or related compound of a metal selected from aluminum, zirconium, cerium, chromium, and iron is applied to the surface of an aluminum material so that the amount of adhering metal becomes 1.0 $mM/m^2$ or more and baked at the specified temperature to form a film of the primer and a step for coating wherein a hydrophilic coating is applied to the primer film formed in the step for priming and baked at the specified temperature to form a hydrophilic film.

This invention also relates to primers useful for the hydrophilic treatment of an aluminum material which comprise water-soluble acrylic acid-based polymers in the range of 3.5 to 22.5 g/l as solids concentration, the nitrate or related compound of a metal selected from aluminum, zirconium, cerium, chromium, and iron in the range of 30 to 500 g/l, a hydrofluoric acid-based compound in the range of 1.0 to 5.0 g/l as elemental fluorine, and an organic reducing agent in the range of 5 to 30 g/l.

This invention further relates to hydrophilic coatings useful for the hydrophilic treatment of an aluminum material which are based on polyvinyl alcohol (PVA) and polyethylene glycol (PEG) or PVA/PEG-based and contain polyvinyl alcohol in the range of 30 to 150 g/l and polyethylene glycol in the range of 3 to 40 g/l.

A primer useful for the step for priming of this invention contains the nitrate or related compound of a metal selected from aluminum, zirconium, cerium, chromium, and iron and is capable of forming a primer film with an amount of adhering metal of 1.0 $mM/m^2$ or more on the surface of an aluminum material and preferably contains water-soluble acrylic acid-based polymers, the nitrate or related compound of a metal selected from aluminum, zirconium, cerium, chromium, and iron, a hydrofluoric acid-based compound, and an organic reducing agent.

Water-soluble acrylic acid-based polymers useful for such primers include water-soluble polymers to be obtained by polymerization or copolymerization of compounds such as acrylic acid, methyl acrylate, ethyl acrylate, isopropyl acrylate, n-butyl acrylate, isobutyl acrylate, methacrylic acid, methyl methacrylate, ethyl methacrylate, isopropyl methacrylate, n-butyl methacrylate, isobutyl methacrylate, maleic acid, and itaconic acid and they may be used singly or as a mixture of two kinds or more. These water-soluble acrylic acid-based polymers need to undergo chelation with the co-existing metal ions to become insoluble in water during baking to be conducted at a relatively low temperature for a short time, and their average molecular weights are preferably 10,000 to 300,000. Such water-soluble acrylic acid-based polymers are available as commercial products, for example, Acumer 2100 and Acumer 1510 (tradename of Rohm and Haas).

The nitrate or related compound of a metal useful for primers of this invention is that of a metal selected from aluminum, zirconium, cerium, chromium, and iron, either of a single metal or a mixture of two or more metals. Concrete examples are aluminum nitrate [$Al(NO_3)_3 \cdot 9H_2O$, molecular weight 375], zirconium nitrate [$Zr(NO_3)_4 \cdot 5H_2O$, molecular weight 492], zirconium oxynitrate [$ZrO(NO_3)_2 \cdot 2H_2O$, molecular weight 267], cerium nitrate [$Ce(NO_3)_3 \cdot 6H_2O$, Molecular weight 434], chromium nitrate [$Cr(NO_3)_3$.

$9H_2O$, molecular weight 400], and iron nitrate [$Fe(NO_3)_3 \cdot 9H_2O$, molecular weight 404].

A primer of this invention contains an organic reducing agent and forms a film in which the organic reducing agent coexists. In case chromium nitrate is used as metal nitrate, any hexavalent chromium ions which form and try to be set free are reduced to trivalent chromium ions and no environmental problem arises as the release of hexavalent chromium ions is completely prevented. However, because of a favorable impression created by chromium-free corrosion-resistant priming, it is desirable that the nitrate or related compound of a metal is that of a metal selected from aluminum, zirconium, cerium, and iron. In particular, the nitrate or related compound of a metal selected from aluminum and zirconium forms primer films which are corrosion-resistant to varying degrees depending upon the amount of adhering metal and, in addition, colorless and transparent and its usage in the primers intended for clear coatings is preferable from the standpoint of accentuating the metallic appearance of aluminum.

Hydrofluoric acid-based compounds to be used in the primers of this invention include, for example, acids and salts such as hydrofluoric acid, fluosilicic acid, fluoboric acid, fluorotitanic acid, fluorozirconic acid, and zinc fluoride and they may be used singly or as a mixture of two kinds or more.

As for organic reducing agents, those which are soluble in water, do not decompose or evaporate during baking, and remain in the primer films to perform a reducing action are satisfactory; concrete examples are polyhydric alcohols and saccharides such as ethylene glycol, glycerol, erythritol, arabitol, mannitol, glucose, and fructose and they may be used singly or as a mixture of two kinds or more.

From the standpoint of improving the resistance to pitting corrosion of the material to be treated, it is allowable to add, if necessary, phosphoric acid-based compounds to the primers of this invention; for example, phosphoric acids such as orthophosphoric acid, pyrophosphoric acid, metaphosphoric acid, and phosphorous acid and, to the extent of 5 g/l or less, alkali phosphates such as sodium phosphate, sodium pyrophosphate, sodium polyphosphates, and sodium hexametaphosphate. Moreover, in order to promote the adhesion of primer film to coating for quality improvement or to raise the viscosity of the priming bath for ease of application and improvement of workability, it is allowable to add silica, preferably pulverized to particles with an average diameter of 1 $\mu$m or less, particularly to primary particles 50% or more of which is 1 $\mu$m or less in diameter.

The primers of this invention usually contain the aforementioned components at the following concentrations: water-soluble acrylic acid-based polymers in the range of 3.5 to 22.5 g/l, preferably 7 to 15 g/l, as solids concentration; nitrate or related compound of metal in the range of 30 to 500 g/l, preferably 50 to 150 g/l; hydrofluoric acid-based compound in the range of 1.0 to 5.0 g/l, preferably 2.0 to 3.0 g/l, as elemental fluorine; phosphoric acid-based compound to be added as needed in the range of 2.5 to 14.5 g/l, preferably 4 to 8 g/l, as $PO_4$; and silica 0.1 or less, preferably 0.05 or less, in terms of the solid ratio [silica/(total solids)].

There is the possibility that water-soluble acrylic acid-based polymers with a solids concentration of less than 3.5 g/l do not give sufficient film-forming performance while those with a solids concentration of more than 22.5 g/l adversely affect the stability of the primers.

Where the nitrate or related compound of a metal is present at a concentration below 30 g/l, more of the primer needs to be applied in order to obtain the amount of adhering metal of 1.0 mM/m$^2$ or more which is required to secure the proper performance of the primer and this increase in the amount of the primer makes it difficult to obtain uniform film thickness on a commercial scale due to sagging during application or non-uniform drying in the treating bath. Conversely, a concentration of higher than 500 g/l not only harms the stability of the bath but also brings about operational instability by narrowing the latitude in controlling the amount of the primer to be applied in order to secure the specified amount of adhering metal.

The organic reducing agent at a concentration of less than 5 g/l lacks the reducing capacity when applied to a chromium-based primer and allows partial formation of hexavalent chromium; when applied to other primers, the neutralization reaction by esterification of excess carboxyl groups of polyacrylic acid proceeds insufficiently with the resultant decline in corrosion resistance. Conversely, at a concentration higher than 30 g/l, the excess of the organic reducing agent remaining unreacted hinders the normal curing reaction of the coating to be applied on the primer.

The phosphoric acid-based compound, added as needed, does not produce the anticipated effect of improving the resistance to pitting corrosion when added at a concentration lower than 2.5 g/l. On the other hand, when added at a concentration higher than 14.5 g/l, it remains partly unreacted in the primer film and impairs the corrosion resistance of the primer film. In the case of silica which is added as needed, the hydrophilicity of the primer film itself improves when the solid ratio [silica/(total solids)] exceeds 0.1, but silica particles join together to make the bath unstable with the passage of time.

The primers of this invention are prepared, for example, as follows: ① aqueous solution A is prepared by dispersing silica to be added as needed uniformly in the water-soluble acrylic acid-based polymers, aqueous solution B is separately prepared by dissolving the nitrate or related compound of a metal and a phosphoric acid-based compound to be added as needed in water, and mixing the two aqueous solutions A and B immediately before use; ② a one-pack composition is prepared by dissolving all the components in water; ③ the components other than the metal nitrate are dissolved in water beforehand and the metal nitrate is added and dissolved immediately before use; and ④ all the components are dissolved in water immediately before use.

In the step for priming of this invention, it is necessary to apply the aforementioned primer to the surface of the aluminum material which is degreased as needed so that the amount of adhering metal becomes 1.0 mM/m$^2$ or more, preferably 1.0 to 6.0 mM/m$^2$, more preferably 1.0 to 3.0 mM/m$^2$, and bake the primer. The amount of adhering metal here refers to the numerical value computed by dividing the weight of the metal adhering on a unit area on the surface of the aluminum material by the atomic weight of the metal. Sufficient corrosion resistance is occasionally not obtained when the amount of adhering metal is lower than 1.0 mM/m$^2$ and, though there is no restriction to the upper limit of this amount from the standpoint of corrosion resistance, application in excess of 5.0 mM/m$^2$ is not desirable as a decline in adhesion of coating films results. The amount of adhering metal can be controlled readily by controlling the concentration of metal nitrates or related compounds in the primers or controlling the number of applications of primers or a combination of these means.

In the cases where the nitrate or related compound of a metal is the nitrate of aluminum or zirconium, in particular, aluminum nitrate, the amount of adhering metal is preferably in the range of 1.5 to 3.0 mM/m$^2$, more preferably in the range of 2.0 to 3.0 mM/m$^2$, and adhesion of this much metal exhibits excellent corrosion resistance and, when used in primers for hydrophilic coatings, produces the effect for markedly improving the hydrophilicity of the films of certain types of such hydrophilic coatings.

In the step for priming, the primers are applied by suitably adopting any of the procedures hitherto known; for example, roll coating or spray coating is applied to aluminum materials of relatively simple shape such as plate and profile while brushing, dip coating, or spray coating is applied to aluminum materials of relatively complex shape.

Baking which follows priming can be performed in the usual manner, for example, by heating at 100 to 300° C., preferably at 150 to 280° C., for 10 seconds to 30 minutes. When heated at a temperature below 100° C., baking and reductive insolubilization take place insufficiently and poor adhesion of the primer film results. On the other hand, when heated at a temperature above 300° C., there is the possibility of the water-soluble acrylic acid-based polymers decomposing and deteriorating.

In particular, the optimal range of the temperature for baking varies with the kind of metal in the nitrate or related compound in use as follows: 140 to 300° C., preferably 140 to 280° C., for aluminum; 140 to 260° C., preferably 140 to 250° C., for zirconium; 100 to 290° C., preferably 140 to 290° C., for cerium: 120 to 300° C., preferably 160 to 290° C., for chromium; and 100 to 140° C., preferably at 100° C., for iron. Choice of a suitable temperature markedly improves the hydrophilicity after press forming. The aforementioned temperature range for baking was chosen on the basis of the hydrophilicity after application of press oil was drying by heating and the preferable temperature range was the range in which water drops of a diameter of 5.5 mm were observed to form after 100-hour immersion in water.

The primer film formed on the surface of the aluminum material in the step for priming of this invention is considered to be composed of three layers as a whole, an extremely thin layer (the first layer) of aluminum fluoride, aluminum silicofluoride, and the like formed in the boundary between the aluminum material and the film, a relatively thick inorganic layer (the second layer) mainly composed of metal compounds formed on the first layer, and an uppermost layer (the third layer) of resins containing silica which is added as needed formed on the second layer.

Hydrophilic coatings useful for the step for coating of this invention are not specific and include water-soluble cellulose, water-soluble acrylic polymers, polyvinyl alcohol, acrylamide, polyethylene glycol, polyvinylpyrrolidone, and amides. From the standpoint of forming highly hydrophilic films by utilizing the interaction of hydrophilic coatings with the films of coat-type primers containing metal nitrates, PVA/PEG-based hydrophilic coatings containing polyvinyl alcohol and polyethylene glycol are preferable.

Polyvinyl alcohol used in the formulation of the aforementioned PVA/PEG-based hydrophilic coatings is of completely saponified type; for example, the degree of saponification is 97.5 to 99.5 mol % and the average degree of polymerization is 500 to 2,500. Polyvinyl alcohol of this type includes its modification in which hydroxyl groups are partly replaced with epoxy groups by copolymerizing a small amount (5% or less) of allyl glycidyl ether, for example, Denacol EX-111 (product of Nagase Chemicals Ltd.) with polyvinyl acetate for the purpose of improving the adhesion of the polyvinyl alcohol film. On the other hand, the weight average molecular weight of polyethylene glycol is 1,000 to 20,000, preferably 4,000 to 11,000.

In the PVA/PEG-based hydrophilic coatings, the proportion of PVA is 30 to 150 g/l, preferably 50 to 100 g/l, and that of PEG is 3 to 40 g/l, preferably 5 to 20 g/l. Film thickness required for securing the intended hydrophilicity cannot be obtained with less than 30 g/l of polyvinyl alcohol while the viscosity of coating becomes so high as to deteriorate the coating workability markedly with more than 150 g/l of polyvinyl alcohol. On the other hand, the effect of the interaction of the film of a coat-type primer containing a metal nitrate and the coating cannot be produced fully with less than 3 g/l of polyethylene glycol while the adhesion of the primer film weakens with more than 40 g/l of polyethylene glycol.

It is allowable to add antiseptics to the aforementioned PVA/PEG-based hydrophilic coatings to prevent them from spoiling during storage and, moreover, add substances based on organic copper compounds, organic iodine compounds, imidazoles, isothiazolines, pyrithiones, triazines and silver compounds positively for the antibacterial and antifungal action. In addition, it is possible to add phthalocyanine pigments to color the coating film. It is also allowable to add surface tension modifiers for improving workability in coating operation or antifoaming agents for preventing foaming in coating operation.

In the preparation of the aforementioned PVA/PEG-based hydrophilic coatings, a means needs to be devised to deal with the fact that polyvinyl alcohol is sparingly soluble in water. A usual practice is to disperse polyvinyl alcohol in water at normal temperature for 5 to 10 minutes, then heat the dispersion at 80 to 90° C. for 30 to 60 minutes, and add water to the resulting solution until the specified concentration is obtained. Polyethylene glycol is added lastly to the polyvinyl alcohol solution with stirring.

The hydrophilic coatings are usually applied to the surface of aluminum materials by a roll coater. A natural-roll coater is adopted for greater coating film thickness and a reverse-roll coater for smooth finish of the surface. A gravure roll which is incised is sometimes used when strict control of the coating weight is desired.

The hydrophilic film is thin, normally 1 $\mu$m or less, and the solids concentration of a hydrophilic coating is 5 to 10% and the coating weight is in the range of 5 to 15 g/m$^2$ in most cases.

The hydrophilic coating is applied to both sides of the primer-coated aluminum material by a roll coater and then normally heated in an air-flotation oven at high temperature (200–300° C.) for a short time (10–15 seconds). In this case, high-temperature air is blown against both sides of the aluminum material at a velocity of 10 to 30 m/min.

The films obtained from the PVA/PEG-based hydrophilic coatings of this invention have a irregular surface structure on a microscopic scale and, because of concentration of polyethylene glycol in the upper layer of the film, the Bowden friction coefficient desirably shows a low value of 0.1.

The film formed by a primer containing the nitrate or related compound of the specified metal in accordance with this invention shows good corrosion resistance and the plausible reason for this is that the nitrate ions undergo thermal decomposition during drying by draining after application of the primer or during baking of the hydrophilic coating and change into oxides or hydroxides which are sparingly soluble in water.

The PVA/PEG-based hydrophilic coatings containing polyvinyl alcohol and polyethylene glycol exhibit better hydrophilicity when applied to the primer film formed by a primer containing the aforementioned nitrate or related compound of the specified metal than when applied directly to a degreased aluminum material without priming in respect to both the hydrophilicity after coating with press oil and drying by heating and the hydrophilicity after 100-hour immersion in water. The reason is not clear, but the plausible explanation is that acidic gases generated by the decomposition of nitrate ions accelerate the etherification reaction of polyvinyl alcohol with polyethylene glycol and that highly hydrophilic polyethylene glycol linked to the hydroxyl groups of polyvinyl alcohol covers the surface of the film and at the same time protects the hydrophilic groups on the surface of the film against heat and press oil.

According to this invention, it is possible to perform priming with excellent corrosion resistance before the application of coatings to the surface of aluminum materials.

DETAILED DESCRIPTION OF THE PREFERRED EMBODIMENTS

Figure 1:
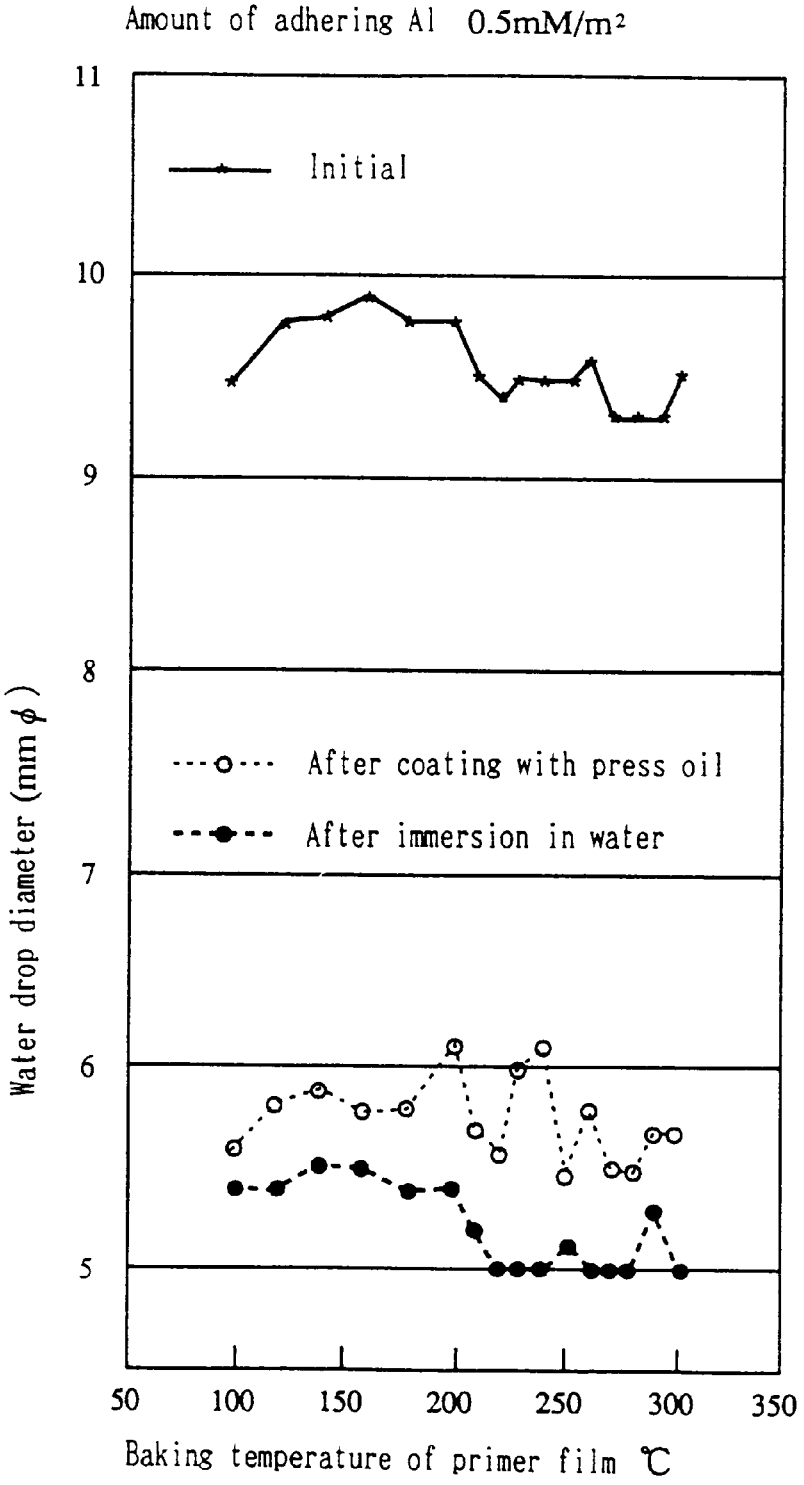
FIG. 1 is a graph showing the relationship between the baking temperature of the primer film and the water drop diameter when the amount of adhering metal (Al) is 0.5 $mM/m^2$ in Experimental Example 1.

A preferred mode of execution of this invention will be described concretely below with reference to the accompanying experimental example.

EXPERIMENTAL EXAMPLE 1

[Preparation of primers]

Aqueous solution A was prepared from polyacrylic acid containing 25% by weight of solids (Acumer 1510, tradename of Rohm and Haas, average molecular weight 60,000) as water-soluble acrylic acid-based polymers, powdered silica in primary particles with an average diameter of 0.01 $\mu$m (Cab-O-Sil, tradename of Cabot Corp.) as silica, and glycerol as an organic reducing agent. Likewise, aqueous solution B was prepared from aluminum nitrate [AlNA: $Al(NO_3)_3 \cdot 9H_2O$, molecular weight 375] as metal nitrate, hydrofluoric acid (about 46%) as hydrofluoric acid-based compound, and orthophosphoric acid (100% $H_3PO_4$) as phosphoric acid-based compound.

The aqueous solutions A and B are mixed so that each component in Experimental Example 1 exists at the following concentration: polyacrylic acid at 7.5 g/l as solids concentration; hydrofluoric acid-based compound at 2.5 g/l as elemental fluorine; glycerol at 10 g/l; orthophosphoric acid at 4.7 g/l as $PO_4$; silica at 0.03 in terms of the solid ratio [silica/(total solids)]; and aluminum nitrate containing water of crystallization at three solids concentration levels of 30, 60, and 120 g/l.

[Preparation of hydrophilic coating]

With the use of polyvinyl alcohol of a saponification degree of 97.5 to 99.5 mol % and an average degree of polymerization of 1,700 and polyethylene glycol of an average degree of polymerization of 8,500, a hydrophilic coating composed of 6% by weight of polyvinyl alcohol and 1.2% by weight of polyethylene glycol was prepared.

[Preparation of test pieces]

The aluminum material (AA3102, 0.15 mm×100 mm×100 mm) was degreased and cleaned in the usual manner, the aforementioned aqueous solutions A and B were mixed to prepare primers containing aluminum nitrate at three solids concentration levels, and each primer was applied immediately after its preparation to the surface of the aluminum material with a gravure roll. The coating weight in the treating bath is controlled by selecting a gravure roll with suitably incised grooves and the actual coating weight can be determined by determining the moisture content in the liquid film before drying with the use of an infrared moisture meter.

After application, the primer was baked in a hot-air oven at the temperature shown in Table 1 for 15 seconds and the primer film was formed on the surface of the aluminum material while the amount of the adhering metal (Al) in the film was controlled at each of the three levels as shown in Table 1.

The aforementioned hydrophilic coating was applied by roll coating to the primer films which had been baked at the specified temperature and contained the specified amounts of adhering metal (Al) and baked in a hot-air oven at 240° C. for 15 seconds to prepare test pieces for Experimental Example 1. Each test piece consisted of the aluminum material on which were formed the primer film and the hydrophilic film with a thickness of 0.8 to 1.0 $\mu$m one upon another.

Each test piece of Experimental Example 1 thus prepared was examined without further treatment for the initial hydrophilicity, then coated with press oil, dried by heating and then examined for the hydrophilicity and appearance (hydrophilicity and appearance after coating with press oil), and thereafter further immersed in water for 100 hours and examined for the hydrophilicity (hydrophilicity after water immersion).

The initial hydrophilicity of each test piece was assessed as follows: the hydrophilic film was placed horizontally, 10 $\mu$L of deionized water was gently dropped on the surface of the film by a micropipette, the water drop was left standing for 30 seconds, the major and minor axes of the water drop were measured, and the hydrophilicity was assessed on the basis of the average of the measured values.

The hydrophilicity after coating with press oil was assessed by coating the test piece with volatile press oil [DN Punch Oil AF2C, product of IIdemitsu Kosan Co., Ltd.], drying at 180° C. for 3 minutes, and thereafter following the same procedure as for the initial hydrophilicity.

The hydrophilicity after water immersion was assessed by immersing the dry, press oil-coated test piece in running deionized water at normal temperature for 100 hours, drying, and thereafter following the same procedure as for the initial hydrophilicity.

In assessing the test piece for each of the initial hydrophilicity, the hydrophilicity after coating with press oil, and the hydrophilicity after water immersion, the test piece was judged hydrophilic when the water drop diameter was 5.5 mm or more (roughly 30° in contact angle). The results are shown in Table 1.

Figure 2:
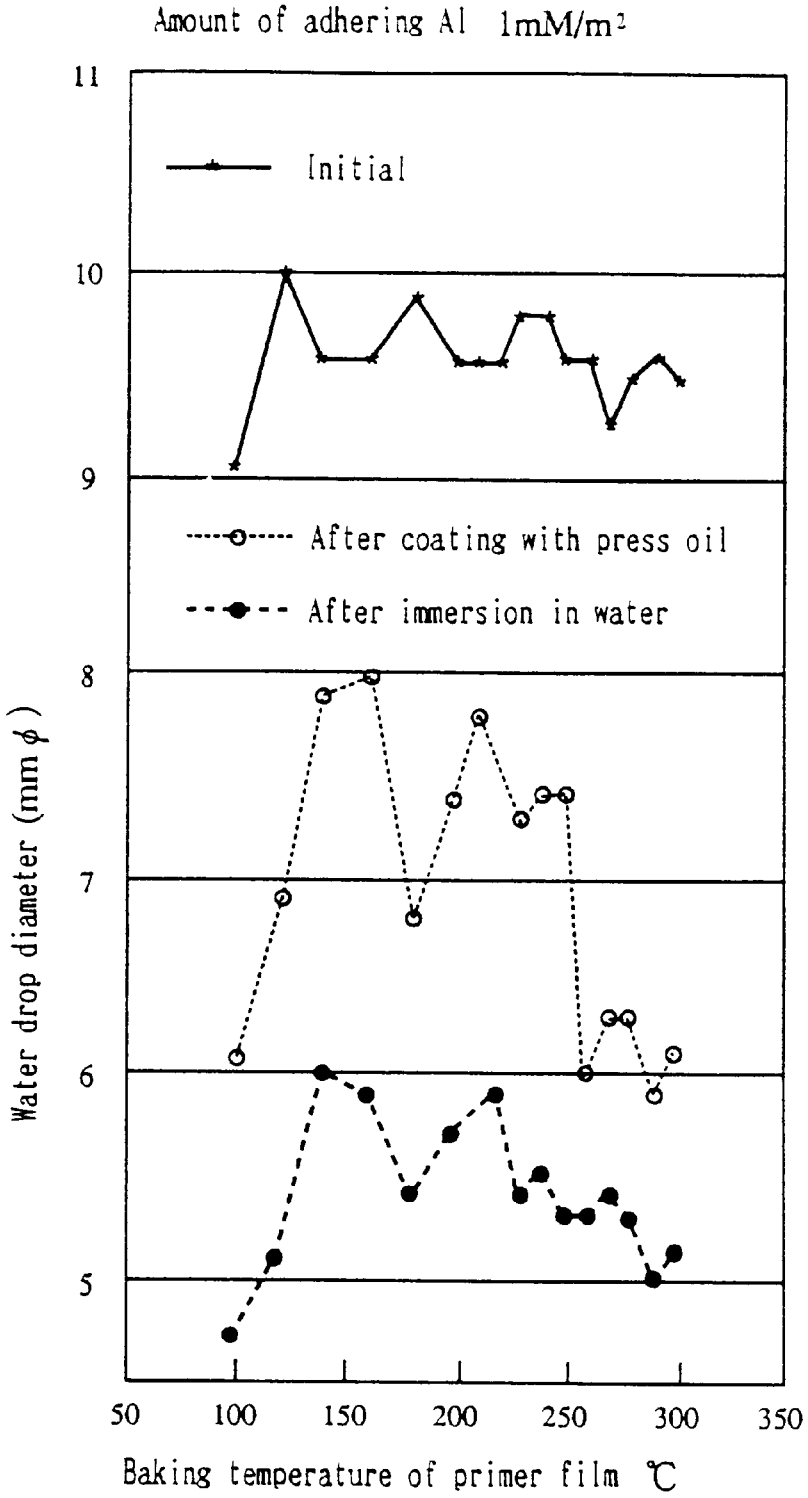
FIG. 2 is a graph, similar to FIG. 1, when the amount of adhering metal (Al) is 1.0 $mM/m^2$ in Experimental Example 1.
Figure 3:
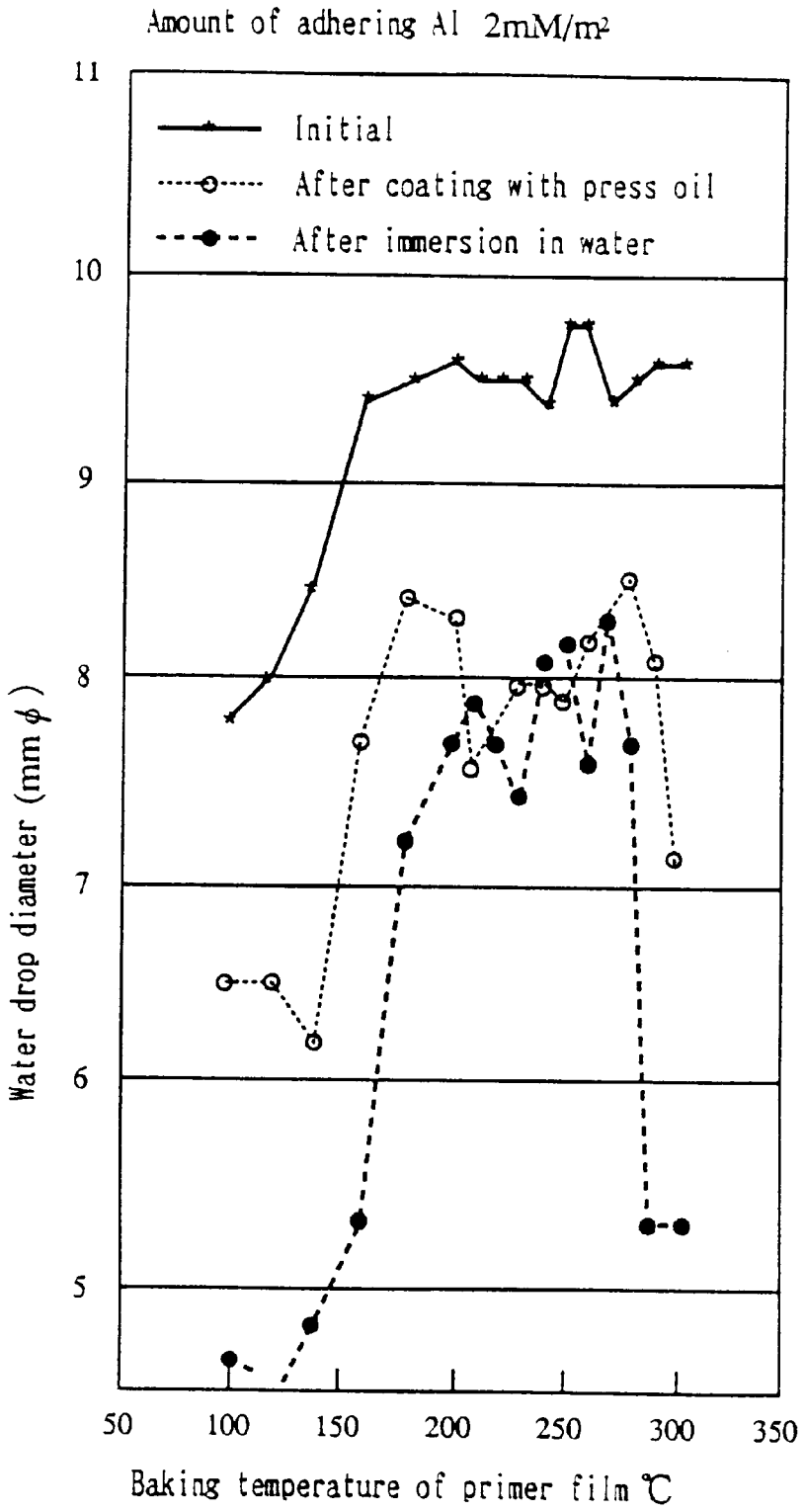
FIG. 3 is a graph, similar to FIG. 1, when the amount of adhering metal (Al) is 2.0 $mM/m^2$ in Experimental Example 1.

The results in Table 1 were graphed in FIGS. 1 to 3 in terms of the relationship between the baking temperature of the primer film and the water drop diameter. The amount of adhering metal (Al) is 0.5 mM/m$^2$ in FIG. 1, 1.0 mM/m$^2$ in FIG. 2, and 2.0 mM/m$^2$ in FIG. 3 respectively.

EXPERIMENTAL EXAMPLE 2

The hydrophilic treatment was conducted as in the aforementioned Experimental Example 1 except substituting zirconium oxynitrate [ZrNA: $ZrO(NO_3)_2 \cdot 2H_2O$, molecular weight 267] for aluminum nitrate as nitrate or related compound of metal, preparing two kinds of primers, one containing 43 g/l of zirconium oxynitrate dihydrate as solids concentration and the other 87 g/l, and forming two kinds of primer films, one with the amount of adhering metal (Zr) of 1.0 mM/m$^2$ and the other 2.0 mM/m$^2$.

Each of the test pieces prepared in Experimental Example 2 was examined for the initial hydrophilicity, the hydrophilicity and appearance after coating with press oil, and the hydrophilicity after water immersion. The results are shown in Table 2.

Figure 4:
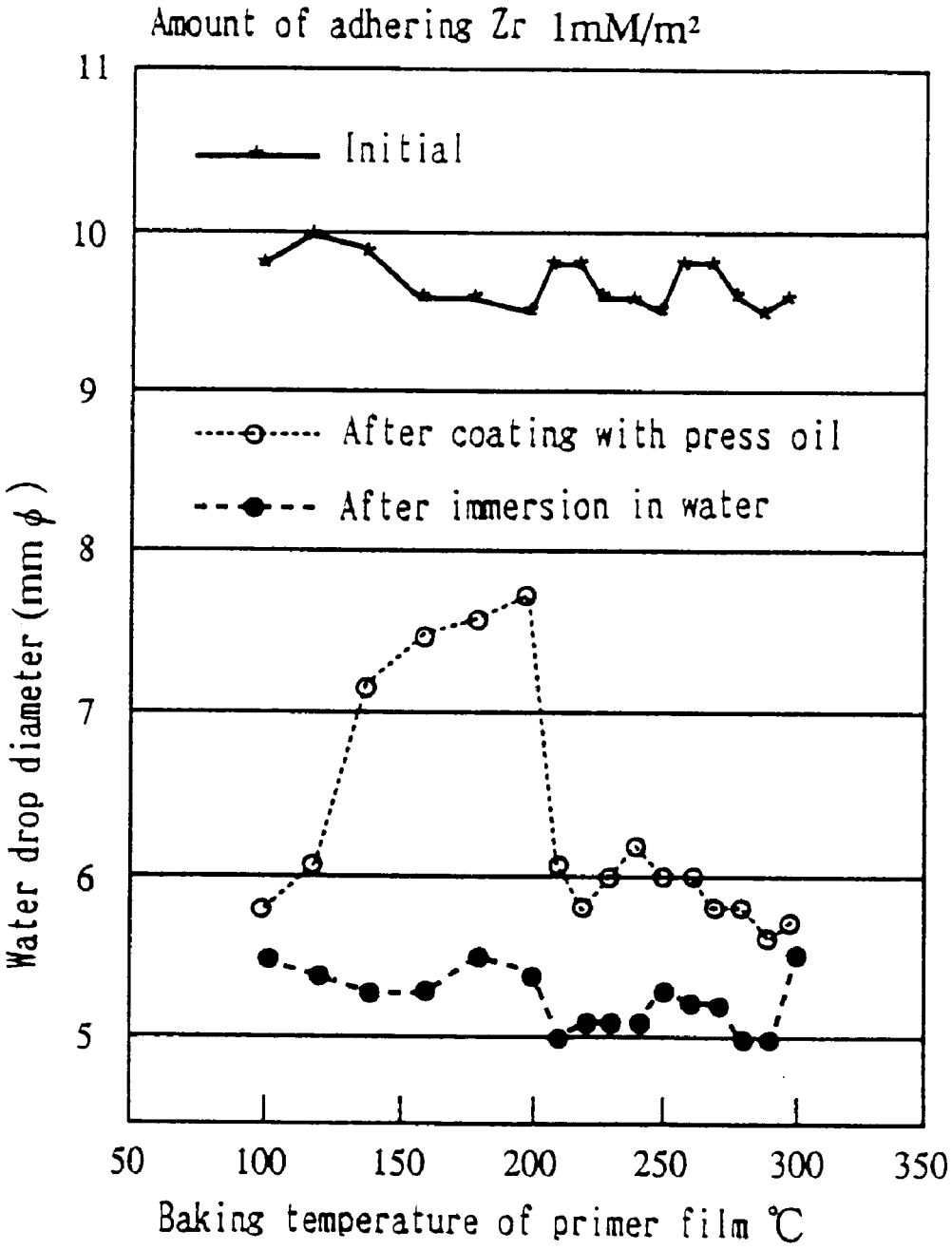
FIG. 4 is a graph, similar to FIG. 1, when the amount of adhering metal (Zr) is 1.0 $mM/m^2$ in Experimental Example 2.
Figure 5:
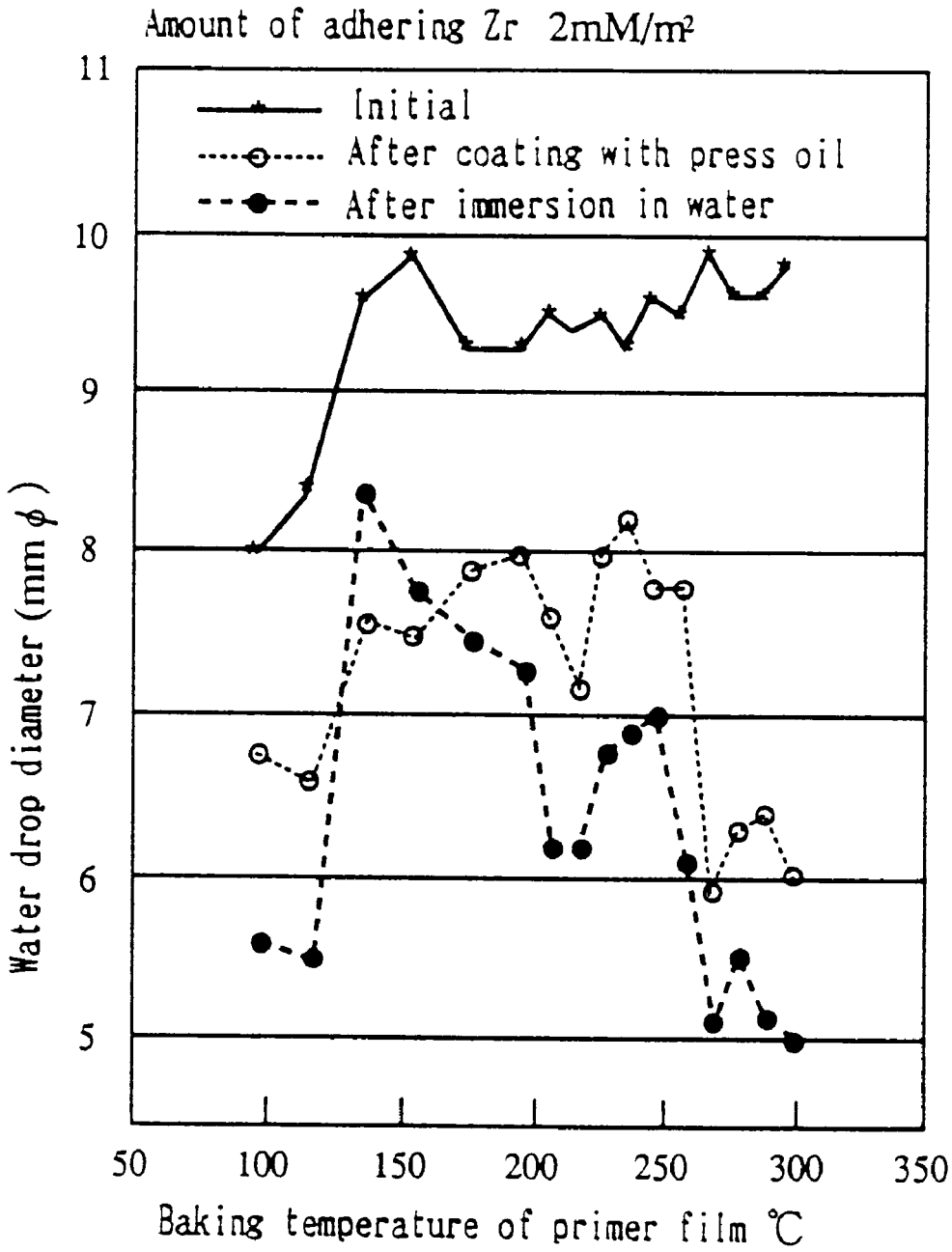
FIG. 5 is a graph, similar to FIG. 1, when the amount of adhering metal (Zr) is 2.0 $mM/m^2$ in Experimental Example 2.

The results of Table 2 were graphed in FIGS. 4 and 5 as in Experimental Example 1.

TABLE 2

| | Amount of adhering metal (Zr) 1.0 mM/m$^2$ | | | | Amount of adhering metal (Zr) 2.0 mM/m$^2$ | | | |
|---|---|---|---|---|---|---|---|---|
| | Hydrophilicity: Water drop diameter (mm ϕ) | | | Appearance | Hydrophilicity: Water drop diameter (mm ϕ) | | | Appearance |
| Baking temperature (° C.) | Initial | After coating with press oil | After Immersion in water | after coating with press oil | Initial | After coating with press oil | After Immersion in water | after coating with press oil |
| 100 | 9.8 | 5.8 | 5.5 | Light | 8.0 | 6.8 | 5.6 | Light |
| 120 | 10.0 | 6.1 | 5.4 | white | 8.4 | 6.6 | 5.5 | yellow |
| 140 | 9.9 | 7.2 | 5.3 | | 9.6 | 7.6 | 8.4 | Trans- |
| 160 | 9.6 | 7.5 | 5.3 | Transl- | 9.9 | 7.5 | 7.8 | parent |
| 180 | 9.6 | 7.6 | 5.5 | ucent | 9.3 | 7.9 | 7.5 | |
| 200 | 9.5 | 7.7 | 5.4 | | 9.3 | 8.0 | 7.3 | |
| 210 | 9.8 | 4.1 | 5.0 | White | 9.5 | 7.6 | 6.2 | |
| 220 | 9.8 | 5.8 | 5.1 | | 9.4 | 7.2 | 6.2 | |
| 230 | 9.6 | 6.0 | 5.1 | | 9.5 | 8.0 | 6.8 | |
| 240 | 9.6 | 6.2 | 5.1 | | 9.3 | 8.2 | 6.9 | |
| 250 | 9.5 | 6.0 | 5.3 | | 9.6 | 7.8 | 7.0 | |
| 260 | 9.8 | 6.0 | 5.2 | | 9.5 | 7.8 | 6.1 | |
| 270 | 9.8 | 5.8 | 5.2 | | 9.9 | 5.9 | 5.1 | White |
| 280 | 9.6 | 5.8 | 5.0 | | 9.6 | 6.3 | 5.5 | |
| 290 | 9.5 | 5.6 | 5.0 | | 9.6 | 6.4 | 5.1 | |
| 300 | 9.6 | 5.7 | 5.5 | | 9.8 | 6.0 | 5.0 | |

(Note)
In the absence of priming (Same as In Table 1)

EXPERIMENTAL EXAMPLE 3

The hydrophilic treatment was conducted as in the aforementioned Experimental Example 1 except substituting cerium nitrate [CeNA: $Ce(NO_3)_3 \cdot 6H_2O$, molecular weight

TABLE 1

| | Amount of adhering metal (Al) 0.5 mM/m$^2$ | | | | Amount of adhering metal (Al) 1.0 mM/m$^2$ | | | | Amount of adhering metal (Al) 2.0 mM/m$^2$ | | | |
|---|---|---|---|---|---|---|---|---|---|---|---|---|
| | Hydrophilicity: Water drop diameter (mm ϕ) | | | Appearance | Hydrophilicity: Water drop diameter (mm ϕ) | | | Appearance | Hydrophilicity: Water drop diameter (mm ϕ) | | | Appearance |
| Baking temperature (° C.) | Initial | After coating with press oil | After Immersion in water | after coating with press oil | Initial | After coating with press oil | After Immersion in water | after coating with press oil | Initial | After coating with press oil | After Immersion in water | after coating with press oil |
| 100 | 9.5 | 5.6 | 5.4 | Light white | 9.1 | 6.1 | 4.7 | Light white | 7.8 | 6.5 | 4.6 | Light yellow |
| 120 | 9.8 | 5.8 | 5.4 | | 10.0 | 6.9 | 5.1 | Translucent | 8.0 | 6.5 | 4.3 | |
| 140 | 9.8 | 5.9 | 5.5 | White | 9.6 | 7.9 | 6.0 | Transparent | 8.5 | 6.2 | 4.8 | Transparent |
| 160 | 9.9 | 5.8 | 5.5 | | 9.6 | 8.0 | 5.9 | | 9.4 | 7.7 | 5.3 | |
| 180 | 9.8 | 5.8 | 5.4 | | 9.9 | 6.8 | 5.4 | | 9.5 | 8.4 | 7.2 | |
| 200 | 9.8 | 6.1 | 5.4 | | 9.6 | 7.4 | 5.7 | | 9.6 | 8.3 | 7.7 | |
| 210 | 9.5 | 5.7 | 5.2 | | 9.6 | 7.8 | 5.8 | | 9.5 | 7.6 | 7.9 | |
| 220 | 9.4 | 5.6 | 5.0 | | 9.6 | 7.6 | 5.9 | | 9.5 | 7.7 | 7.7 | |
| 230 | 9.5 | 6.0 | 5.0 | | 9.8 | 7.3 | 5.4 | | 9.5 | 8.0 | 7.4 | |
| 240 | 9.5 | 6.1 | 5.0 | | 9.8 | 7 4 | 5.5 | | 9.4 | 8.0 | 8.1 | |
| 250 | 9.5 | 5.5 | 5.1 | | 9.6 | 7.4 | 5.3 | | 9.8 | 7.9 | 8.2 | |
| 260 | 9.6 | 5.8 | 5.0 | | 9.6 | 6.0 | 5.3 | White | 9.8 | 8.2 | 7.6 | |
| 270 | 9.3 | 5.5 | 5.0 | | 9.3 | 6.3 | 5.4 | | 9.4 | 8.3 | 8.3 | |
| 280 | 9.3 | 5.5 | 5.0 | | 9.5 | 6.3 | 5.3 | | 9.5 | 8.5 | 7.7 | |
| 290 | 9.3 | 5.7 | 5.3 | | 9.6 | 5.9 | 5.0 | | 9.6 | 8.1 | 5.3 | |
| 300 | 9.5 | 5.7 | 5.0 | | 9.5 | 6.1 | 5.1 | | 9.6 | 7.1 | 5.3 | Light white |

(Notes)
In the absence of priming (Initial water drop diameter: 9.5 mm ϕ; Water drop diameter after coating press oil: 6.0 mm ϕ; Appearance after coating with press oil: White)

434], iron nitrate [FeNA: $Fe(NO_3)_3 \cdot 9H_2O$, molecular weight 404] or chromium nitrate [CrNA: $Cr(NO_3)_3 \cdot 9H_2O$, molecular weight 400] for aluminum nitrate as nitrate or related compound of metal, preparing three kinds of primers, a first one containing 73 g/l of cerium nitrate hexahydrate, a second one containing 63 g/l of iron nitrate nonahydrate, and a third one containing 67 g/l of chromium nitrate nonahydrate as solids concentration, and forming three kinds of films with the amount of adhering metal controlled at 1.0 mM/m$^2$ for Ce, 1.1 mM/m$^2$ for Fe, and 1.0 mM/m$^2$ for Cr.

Each of the test pieces prepared in Experimental Experiment 3 was examined for the initial hydrophilicity, the hydrophilicity and appearance after coating with press oil, and the hydrophilicity after water immersion. The results are shown in Table 3.

TABLE 3

| | Amount of adhering metal (Ce) 1.0 mM/m$^2$ | | | | Amount of adhering metal (Fe) 1.1 mM/m$^2$ | | | | Amount of adhering metal (Cr) 1.0 mM/m$^2$ | | | |
|---|---|---|---|---|---|---|---|---|---|---|---|---|
| | Hydrophilicity: Water drop diameter (mm ϕ) | | | Appearance | Hydrophilicity: Water drop diameter (mm ϕ) | | | Appearance | Hydrophilicity: Water drop diameter (mm ϕ) | | | Appearance |
| Baking temperature (° C.) | Initial | After coating with press oil | After Immersion in water | after coating with press oil | Initial | After coating with press oil | After Immersion in water | after coating with press oil | Initial | After coating with press oil | After Immersion in water | after coating with press oil |
| 100 | 10.6 | 10.1 | 6.4 | Translucent | 10.3 | 7.4 | 5.7 | Transparent | 6.0 | 5.9 | 5.7 | Light white |
| 120 | 9.6 | 9.3 | 5.0 | Transparent | 9.6 | 5.8 | 5.1 | White | 10.1 | 8.3 | 6.1 | Transparent |
| 140 | 9.4 | 8.0 | 6.2 | | 9.4 | 5.6 | 5.0 | | 10.0 | 8.1 | 10.4 | |
| 160 | 9.6 | 8.3 | 5.8 | | 9.3 | 6.5 | 5.3 | | 10.0 | 8.3 | 8.8 | |
| 180 | 10.3 | 8.8 | 6.3 | | 9.5 | 6.2 | 5.3 | | 9.9 | 9.0 | 9.8 | |
| 200 | 10.8 | 9.2 | 6.3 | | 9.6 | 6.0 | 5.5 | | 10.2 | 8.6 | 9.0 | |
| 210 | 9.3 | 9.3 | 6.0 | | 10.3 | 5.7 | 5.4 | | 10.0 | 7.9 | 9.8 | |
| 220 | 10.5 | 8.6 | 5.6 | | 9.9 | 5.5 | 5.3 | | 10.2 | 8.8 | 11.8 | |
| 230 | 10.5 | 8.5 | 8.0 | | 10.0 | 5.5 | 5.3 | | 10.2 | 9.2 | 11.3 | |
| 240 | 10.6 | 9.1 | 7.8 | | 10.0 | 5.5 | 5.3 | | 10.1 | 8.9 | 9.3 | |
| 250 | 10.5 | 8.8 | 7.0 | | 10.0 | 5.5 | 5.3 | | 10.0 | 9.0 | 9.6 | |
| 260 | 11.0 | 8.8 | 8.7 | | 9.9 | 5.5 | 5.2 | | 9.9 | 9.4 | 8.9 | |
| 270 | 10.5 | 9.0 | 8.5 | | 10.1 | 5.6 | 5.1 | | 10.0 | 9.2 | 9.6 | |
| 280 | 10.6 | 8.1 | 8.7 | | 9.8 | 5.4 | 5.1 | | 10.0 | 9.2 | 9.2 | |
| 290 | 10.4 | 7.7 | 7.1 | | 9.0 | 5.4 | 5.0 | | 10.1 | 8.6 | 10.4 | |
| 300 | #0.6 | 6.0 | 5.3 | Light white | 9.5 | 5.7 | 5.1 | | 9.9 | 9.4 | 8.0 | |

(Note)
In the absence of priming (Same as In Table 1)

What is claimed is:

1. A process for hydrophilic treatment of an aluminum material which comprises a step for priming wherein a primer containing 3.5 to 22.5 g/l as solids concentration of water-soluble acrylic acid-based polymers, 1.0 to 5.0 g/l of a hydrofluoric acid-based compound as elemental fluorine, 5 to 30 g/l of an organic reducing agent, and a nitrate or related compound of a metal selected from aluminum, zirconium, cerium, chromium, and iron is applied to the surface of an aluminum material so that the amount of adhering metal becomes 1.0 mM/M$^2$ or more and then the primer is baked by heating at 100 to 300° C. to form a film of the primer and a step for coating wherein a hydrophilic coating is applied to the film of the primer formed in said step for priming and then baked by heating at 200 to 300° C. to form a hydrophilic film.

2. A process for hydrophilic treatment of an aluminum material as described in claim 1 wherein said primer contains the nitrate or related compound of a metal in the range of 30 to 500 g/l.

3. A process for hydrophilic treatment of an aluminum material as described in claim 1 or 2 wherein said primer contains a phosphoric acid-based compound in the range of 2.5 to 14.5 g/l as $PO_4$.

4. A process for hydrophilic treatment of an aluminum material as described in claim 1 or 2 wherein said primer contains silica in the range up to 0.1 in terms of the solid ratio.

5. A process for hydrophilic treatment of an aluminum material as described in claim 1 or 2 wherein baking in the step for priming is performed at 160 to 280° C. in case the metal in the nitrate or related compound is aluminum, at 140 to 260° C. in case the metal is zirconium, at 100 to 290° C. in case the metal is cerium, at 120 to 300° C. in case the metal is chromium, and at 100 to 140° C. in case the metal is iron.

6. A process for hydrophilic treatment of an aluminum material as described in claim 1 or 2 wherein the hydrophilic coating is PVA/PEG-based and contains polyvinyl alcohol (PVA) and polyethylene glycol (PEG).

7. The process for hydrophilic treatment of an aluminum material according to claim 1, wherein the related compound of a metal is selected from the group consisting of aluminum nitrate, zirconium nitrate, zirconium oxynitrate, cerium nitrate, chromium nitrate and iron nitrate.

* * * * *